United States Patent [19]

Silvestri, Jr.

[11] 3,973,402

[45] Aug. 10, 1976

[54] CYCLE IMPROVEMENT FOR NUCLEAR STEAM POWER PLANT

[75] Inventor: George J. Silvestri, Jr., Morton, Pa.

[73] Assignee: Westinghouse Electric Corporation, Pittsburgh, Pa.

[22] Filed: Jan. 29, 1974

[21] Appl. No.: 437,591

[52] U.S. Cl. ..... 60/678; 60/680; 176/65

[51] Int. Cl.[2] ..... F01K 7/34

[58] Field of Search ..... 176/55, 56, 61, 64, 176/65; 60/654, 678, 680

[56] References Cited

UNITED STATES PATENTS

| | | | |
|---|---|---|---|
| 2,268,356 | 12/1941 | Turner | 60/654 |
| 3,173,267 | 3/1965 | Takeda | 60/678 |
| 3,314,236 | 4/1967 | Zanoni | 60/654 |
| 3,359,174 | 12/1967 | Heiblung | 176/65 X |
| 3,438,202 | 4/1969 | Roe | 60/678 |

*Primary Examiner*—Stephen C. Bentley
*Assistant Examiner*—Harold Tudor
*Attorney, Agent, or Firm*—G. H. Telfer

[57] ABSTRACT

A pressure-increasing ejector element is disposed in an extraction line intermediate to a high pressure turbine element and a feedwater heater. The ejector utilizes high pressure fluid from a reheater drain as the motive fluid to increase the pressure at which the extraction steam is introduced into the feedwater heater. The increase in pressure of the extraction steam entering the feedwater heater due to the steam passage through the ejector increases the heat exchange capability of the extraction steam thus increasing the overall steam power plant efficiency.

3 Claims, 2 Drawing Figures

FIG.1
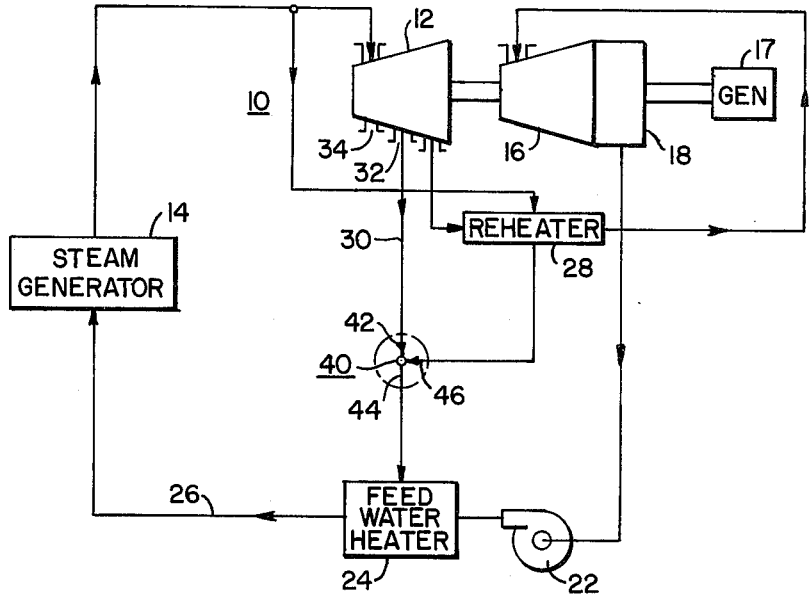
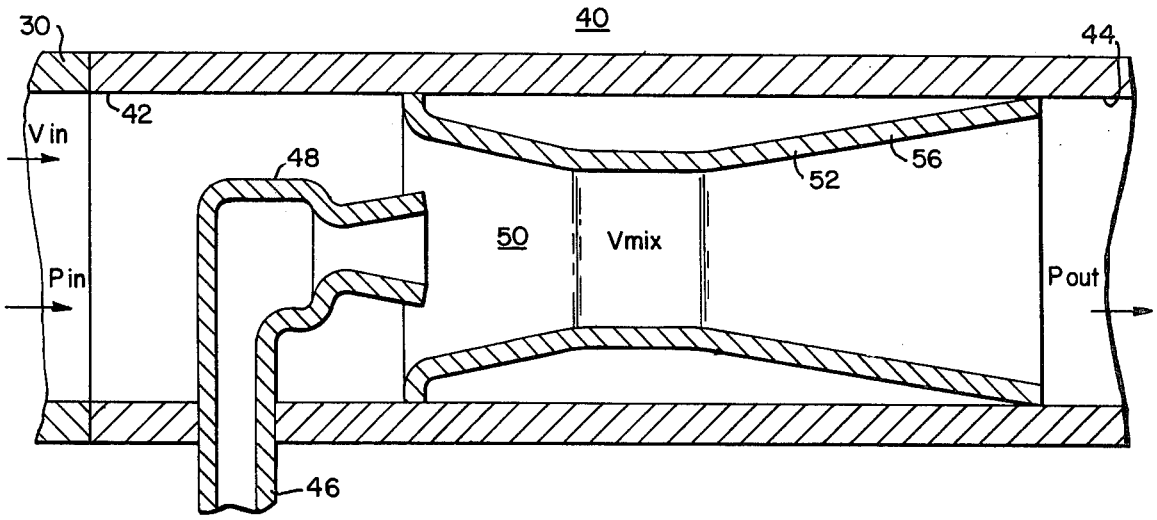
FIG. 2

CYCLE IMPROVEMENT FOR NUCLEAR STEAM POWER PLANT

BACKGROUND OF THE INVENTION

1. Field of the Invention

This invention relates to steam turbine power plants, and more particularly, to a nuclear steam power plant incorporating a pressure-increasing device in the steam system.

2. Description of the Prior Art

It is well known to those skilled in the art of steam power generation that nuclear steam turbine systems with saturated or superheated steam conditions usually employ reheating to improve the thermal efficiency of the system. In most cases, throttle steam alone, or in conjunction with partially expanded steam from a high pressure turbine extraction zone, is used to superheat the high pressure turbine exhaust flow after it has been dried in a moisture separator.

It is also well known to those skilled in the art of steam power generation that a plurality of feedwater heaters are usually employed to increase the temperature of a condensate taken from a condenser element within the steam power system before that condensate is reintroduced into a primary steam generator section. Increasing the temperature of the condensate prior to reintroduction into the primary heater section increases the overall efficiency of the power plant. It has been the practice in the art to heat the condensate in the feedwater heater through the use of high pressure turbine element. Of course, lower pressure feedwater heaters may be employed in series between the condenser and the final feedwater heater to provide gradual step increases of the condenser temperature prior to its introduction into the primary steam generator section.

It is the general practice in the art to cascade the condensed throttle steam found in the reheater drains into the highest pressure feedwater heater. The usual pressure difference between the pressure within the reheater drains and the pressure of the extraction steam introduced into the final feedwater heater is approximately 500 psi. The reheater drains are introduced into the final feedwater heater as an alternative to introduction of the reheater drains into the discharge conduit of the final feedwater heater. However, the possibility that the condensed throttle steam from the reheater drain would flash, that is, pass from the liquid to the gaseous state due to the temperature increase at the decreased ambient pressure, resulted in abandonment of this approach. In order to avoid flashing, and the concomitant cavitation engendered within the discharge conduit of the final feedwater heater, the condensed throttle steam from the reheater drains are introduced into the shell of the final feedwater heater. It is obvious, however, that introduction of the condensed throttle steam from the reheater drain having a pressure energy approximately 500 psi higher than the pressure of the extraction steam represents a dissipation of available energy within the system.

The feedwater heater capacity to transfer heat to the condensate passing therethrough is directly dependent upon the temperature of the extraction steam used as a heating medium. In turn, the temperature of the extraction steam depends upon the pressure level within the extraction steam. It therefore follows that an increase in the pressure of the extraction steam will increase the temperature of the extraction steam used as a heating medium in the feedwater heater. Thus, higher pressure extraction steam will directly result in increased heating capacity within the feedwater heater.

Extraction of steam from the high pressure turbine elements at a point in the high pressure turbine closer to the inlet orifice than is presently being used is one directly available source of higher pressure extraction steam. It is obvious that tapping steam within the high pressure turbine element at an earlier point will provide a higher extraction steam pressure. However, a disadvantage to such a relocation of the extraction zone is that the overall output or work of the power plant would be lowered since steam capable of producing useful work is diverted from the system.

SUMMARY OF THE INVENTION

This invention utilizes the high pressure reheater drains as the motive energy in a pressure-increasing ejector element to increase the pressure of the extraction steam flow supplying the highest pressure feedwater heater. The ejector element is connected to the high pressure reheater drain and utilizes a high pressure reheater drain fluid as the motive fluid to increase the velocity of the extraction steam which has been introduced into the ejector element at a separate inlet point. The extraction steam is then passed through a diffuser element which decreases the velocity of the extraction steam and provides a concomitant pressure increase to the extraction steam flow. Passage of the extraction steam flow through the ejector element raises the pressure in the extraction steam to a predetermined level prior to introduction of the extraction steam into the feedwater heater.

It is an object of this invention to provide an increase in the final feedwater temperature for predetermined turbine extraction pressure through the use of the high pressure reheater drain as the motive fluid within a pressure-increasing ejector element. It is a further object of this invention to increase the heat exchange capability of extraction steam in a final feedwater heater by increasing the pressure of the extraction steam at the point of introduction into the feedwater heater.

BRIEF DESCRIPTION OF THE DRAWING

The invention will be more fully understood from the following detailed description of an illustrative embodiment taken in connection with the accompanying drawings, in which:

FIG. 1 is a diagrammatic view, showing an element of a nuclear steam power plant utilizing a pressure-increasing device therein; and, FIG. 2 is an elevational view, entirely in section, of a pressure-increasing device utilized by this invention.

DESCRIPTION OF THE PREFERRED EMBODIMENT

Throughout the following description, similar reference characters refer to similar elements in all figures of the drawings.

Referring now to FIG. 1, this figure illustrates a diagrammatic view of a nuclear steam power plant incorporating a pressure-increasing device according to the teachings of this invention. The power plant 10 comprises a high pressure turbine element 12 being supplied with high pressure, high temperature steam from a steam generator section 14. The steam expands through the high pressure turbine element 12 and through lower pressure turbine element 16 to convert the energy carried by the motive fluid into mechanical rotational energy to produce electricity in a generator element 17.

After expanding through the turbine elements within the power plant 10 the steam is returned to the liquid state in a condenser element 18. The condensate from the condenser 18 is then returned to the primary steam generator section 14.

A boiler feed pump 22 forces condensate from the condenser element into a final feedwater heater 24. The final feedwater heater 24 increases the efficiency of the nuclear steam power plant 10 by raising the temperature of the condensate pumped thereinto by the boiler feed pump 22. The feedwater heater 24 discharges the condensate into a discharge conduit 26. The condensate has a temperature upon discharge from the feedwater heater higher than the temperature of the condensate introduced into the feedwater heater 24 from the boiler feed pump 22.

In order to further increase the efficiency of the power plant 10, the high pressure turbine exhaust flow is reheated within a reheater element 28 disposed between the high pressure turbine 12 and the low pressure turbine 16. Reheating is accomplished through the use of steam taken from the throttle of the high pressure turbine 12 used alone or in combination with partially expanded steam from the high pressure turbine 12.

The feedwater heater 24 derives its heating source from a high pressure extraction line 30. The high pressure extraction line 30 is located at a predetermined position 32 within the high pressure turbine element 12 and draws therefrom high temperature steam having a given predetermined extraction pressure. In the prior art, the extraction steam was introduced directly into the shell of the feedwater heater 24. Also, in the prior art, the condensed throttle steam in the reheater element 28 was introduced directly into the shell of the feedwater heater 24 at a point of entry distinct from that of the extraction steam.

However, the pressure energy within the high energy reheater drain is approximately 500 psi greater than the pressure level within the extraction steam introduced into the feedwater heater 24. This pressure difference between the extraction steam and the reheater drain represents a useful energy differential which is not utilized in the prior art.

As is well known to those skilled in the art, the heat transfer capability of the feedwater heater depends upon the temperature of the extraction steam introduced thereinto. The temperature of the extraction steam is directly related to the pressure at which the extraction steam is introduced into the feedwater heater. Thus, it is evident, that to increase the pressure of the extraction steam introduced into the feedwater heater 24 results in an increase in the capability of that extraction steam to heat the condensate with the feedwater heater 24.

One method of increasing the pressure of the extraction steam introduced into the feedwater heater would be to locate the extraction zone at a point 34 in the high pressure turbine 12 closer to the inlet of the high pressure turbine 12. Thus, steam would be taken from the turbine 12 having a higher pressure level therein. However, extraction of steam from a higher pressure zone is disadvantageous in that it diverts a portion of high energy steam which can produce useful work within the turbine element 12.

This invention uses the high pressure energy within the reheater 28 drains as the motive fluid for pressure-increasing means. This is accomplished with an ejector element 40, which increases the pressure of the extraction steam introduced into the feedwater heater 24. The ejector element 40 has an inlet 42 and an outlet 44 connected, as indicated in FIG. 1, within the extraction line 30. The ejector 40 is disposed intermediate between the high energy turbine element 12 and the feedwater heater 24. The drain of the reheater 28 is connected to a nozzle inlet 46 on the ejector element 40.

Referring now to FIG. 2, an elevational view of the ejector element 40 is disclosed. The high energy, low velocity condensed throttle steam within the reheater drains is connected to a nozzle inlet 46 of the ejector element 40. The high pressure reheater fluid enters a supersonic nozzle 48 within the ejector element 40. The high energy reheater fluid passing through the supersonic nozzle element 48 undergoes a decrease in pressure and a concomitant increase in velocity due to the configuration of the nozzle 48. The reheater fluid exits the nozzle 48 and enters a mixing volume 50, defined by a mixing tube 52 disposed within the ejector 40.

The extraction line 30, connected to the ejector inlet 42, carries the extraction steam flow into the ejector 40 with a predetermined velocity indicated $V_{in}$ and a predetermined pressure $P_{in}$. The extraction steam flow passes around the supersonic nozzle 48 and enters the mixing volume 50 defined on the interior of the ejector 40.

Within the mixing volume 50, defined by the mixing tube 52, the velocity of the extraction steam is increased due to interactions with the high velocity reheater fluid discharged from the nozzle 48 into the mixing volume 50. The intermingling of the extraction steam and the high velocity reheater drain fluid in the mixing volume 50 imparts a velocity $V_{mix}$ to the extraction steam in the mixing volume 50. The velocity of the combined extraction steam and reheater fluid is therefore increased in the mixing volume 50 to a velocity higher than the inlet velocity $V_{in}$.

The high velocity extraction steam and reheater fluid is then introduced into a diffuser portion 56 within the ejector 40. The diffuser portion 56 reduces the velocity of the extraction steam and causes a pressure increase to occur in the extraction steam flow as the flow exits the ejector 40 at the outlet 44 thereof. The pressure of the extraction steam flow at the outlet 44 of the ejector 40 is denominated $P_{out}$.

It is thus seen that the extraction steam entering the inlet 42 of the ejector 40 with a predetermined pressure $P_{in}$ exits the ejector 40 at outlet 42 having a pressure $P_{out}$. The pressure $P_{out}$ exceeds the pressure $P_{in}$ of the extractor steam flow. It is thus seen that utilization of the high pressure reheater drain fluid with the ejector 40 causes a pressure increase to occur within the extraction steam flow.

Referring again to FIG. 1, after passing through the ejector element 40, the higher pressure extraction steam flow is introduced into the feedwater heater 24. Introduction of the higher pressure extraction steam into the feedwater 24 increases the temperature of the extraction steam within the feedwater heater. Increase in temperature of the extraction steam within the feedwater heater 24 increases the heat transfer capability of the feedwater heater 24. The temperature of the condensate discharge into the conduit 26 after passage through the feedwater heater 24 is thus increased in temperature, thereby increasing the efficiency of the overall power plant 10.

It is thus seen that through the use of a pressure increasing ejector device in the steam power plant, pressure energy which in the prior art was dissipated without any benefit whatsoever is utilized to increase the inlet pressure and therefore the inlet temperature of an extraction steam flow into a feedwater heater.

It is thus seen that a steam power plant utilizing the teachings of this invention will increase the overall efficiency of the power plant 10 by raising the temperature of the final feed introduced into the steam generator 14.

It is also seen that the power plant system 10 has further advantages and capabilities associated therewith. Since disposition of the pressure-increasing ejector element 40 using the condensed throttle steam from the reheater drains as the motive fluid therein can increase the pressure of the extraction steam flow, a steam power plant utilizing the teachings of this invention can extract steam at a lower pressure extraction zone than is now being utilized. By extracting a lower pressure extraction flow from the turbine 12 and disposing the pressure-increasing device according to the teachings of this invention, a higher volume of high pressure steam flows through the turbine elements of the system, yet no diminution in the function of the feedwater heater is experienced.

Since the pressure energy of the reheater drain fluid is currently dissipated without any beneficial use whatsoever being obtained therefrom, it is realized that by utilizing the teachings of this invention in a steam power plant, increased overall efficiency of the power plant can be effected.

I claim:

1. A steam turbine power plant comprising:

a closed-loop turbine arrangement having at least a steam generator element connected in series to a high pressure turbine element, a low pressure turbine element and a condenser element, said high pressure turbine element having an extraction zone, an inlet and an exhaust each separate from the other therein;

a feedwater heater connected between said condenser element and said steam generator element;

extraction means for extracting steam from said extraction zone to said feedwater heater;

a source of fluid having a pressure therein higher than the pressure at the extraction zone of said high pressure turbine element; and, means for increasing the pressure of the steam extracted from said high pressure turbine, said pressure increasing means being activated by fluid from said fluid source, said pressure-increasing means being connected within said extraction means.

2. The power plant of claim 1 wherein said closed-loop turbine arrangement has a reheater element connected between said high pressure turbine and said low pressure turbine, said reheater having an inlet and a drain, the pressure of the fluid within the drain of said reheater element being greater than the pressure at the inlet of said low pressure turbine, said source fluid comprising said drain of said reheater element.

3. The power plant of claim 2, wherein said pressure-increasing means comprises an ejector element.

* * * * *